US006997738B1

(12) United States Patent
Sutherland

(10) Patent No.: US 6,997,738 B1
(45) Date of Patent: Feb. 14, 2006

(54) WIRE-IDENTIFICATION PLUGS FOR ELECTRONIC DEVICES

(76) Inventor: Paul M. Sutherland, 279 Shady Oak Ct., Piscataway, NJ (US) 08854

( * ) Notice: Subject to any disclaimer, the term of this patent is extended or adjusted under 35 U.S.C. 154(b) by 0 days.

(21) Appl. No.: 10/820,850

(22) Filed: Apr. 9, 2004

(51) Int. Cl.
*H01R 3/00* (2006.01)

(52) U.S. Cl. ..... 439/488; 439/491; 439/148; 40/316; 174/112

(58) Field of Classification Search ..... 439/488, 439/489, 491, 148, 149, 150, 134; 40/316; 174/112
See application file for complete search history.

(56) References Cited

U.S. PATENT DOCUMENTS 3,786,393 A * 1/1974 Conrad ..... 439/70
3,989,338 A * 11/1976 Gosser ..... 439/43
4,293,173 A * 10/1981 Tricca ..... 439/148
D263,698 S 4/1982 Loof et al.
4,656,767 A 4/1987 Tarrant
4,886,471 A * 12/1989 Fleshman, Jr. ..... 439/587
4,947,568 A 8/1990 De Barbieri
5,111,605 A 5/1992 Bossi
5,139,440 A * 8/1992 Volk et al. ..... 439/413
5,187,887 A 2/1993 Mori et al.
5,533,917 A * 7/1996 Schmitz ..... 439/894
5,775,935 A * 7/1998 Barna ..... 439/488
6,114,633 A * 9/2000 Duhancik ..... 174/152 GM
6,311,637 B1 11/2001 Moss
6,390,848 B1 * 5/2002 Murakami et al. ..... 439/587
6,785,131 B2 * 8/2004 Ewell et al. ..... 361/686

* cited by examiner

*Primary Examiner*—Hien Vu
*Assistant Examiner*—X. Chung-Trans

(57) ABSTRACT

A kit for marking a predetermined position of at least one wire connected to an electronic device includes at least one male plug that has an elongated prong section integral with the body. The prong section includes an end portion spaced forwardly of the body and is removably positionable into an input jack of an electronic device. The rear end portion of the body has indicia thereon unique to a select input jack. The kit further includes at least one female plug that has a groove formed therein and extends along the longitudinal axis thereof for receiving a male end portion of a wire when removed from an input jack. The body further has a visible front end portion provided with indicia thereon wherein the front end portion indicia of the female plug corresponds to the rear end portion indicia of the male plug so that a user can identify a select input jack for receiving a corresponding wire.

9 Claims, 3 Drawing Sheets

WIRE-IDENTIFICATION PLUGS FOR ELECTRONIC DEVICES

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a wire-identification kit and, more particularly, to wire-identification plugs for assisting users to reconnect a plurality of wires after they are removed from an electronic device.

2. Prior Art

As is known, in the implementation of electrical systems it is essential that all the used electric cables be identified in relation to a system diagram so as to facilitate their installation and subsequent interventions for maintenance.

Various different forms of strips and bands including identifying and/or or other indicia thereon heretofore have been provided for securement about and/or support from a mid-portion of an elongated member. However, these previously known devices are not specifically designed for use in identifying elongated cables and, accordingly, do not include the simplified structure of the instant invention capable of attaching an identifying tag to the insulation disposed about an electrical cable or wire in a manner such that the identifying tag will be maintained stationary on the cable, independent of vertical or horizontal orientation of the cable and/or vibration of the cable.

Another common method of identifying wires, electrical terminals and the like comprises attaching pre-printed strips of marked, adhesive tape on the wire to create the desired marking. Commonly, such pre-printed strips are provided on small cards, which can be carried around with the electrician or electrical technician responsible for marking the wires. The disadvantage of such a method of marking wires is that it is difficult and time consuming to wrap a number of pieces of adhesive tape around the wire to be marked one at a time. It is particularly difficult to mark wires in such a fashion when the wires are disposed in a tight space. A further disadvantage of such devices is that the adhesive tape upon which each of the symbols constituting the marking is placed commonly wear out after a period of time. The adhesive may also become loosened due to heat or high humidity.

Accordingly, a need remains for multi-colored wire-identification plugs for electronic devices, which overcome the above-noted shortcomings.

BRIEF SUMMARY OF THE INVENTION

In view of the foregoing background, it is therefore an object of the present invention to provide a kit including multi-numbered wire-identification plugs for electronic devices. These and other objects, features, and advantages of the invention are provided by a kit for marking a predetermined position of at least one wire connected to an electronic device.

The kit includes at least one male plug that has a substantially cylindrical body and front and rear end portions. The male plugs are preferably formed from non-conductive material and the body has a centrally disposed longitudinal axis that includes an elongated prong section extending therealong. The prong section is integral with the body and has a first end portion disposed substantially medially of the front and rear end portions. The prong section is preferably formed from non-conductive material that is resilient so that the prong section can be selectively adapted into a plurality of shapes as desired by a user. For example, the prong section may be adapted to have an octagonal cross-section, in a preferred embodiment.

The prong section further has a second end portion spaced forwardly of the front-end portion and is removably positionable into an input jack of an electronic device. The rear end portion of the body advantageously has indicia thereon, which is unique to the selected input jack.

The present invention further includes at least one female plug that has a substantially cylindrical body and a centrally disposed longitudinal axis. The female plugs are preferably formed from non-conductive material. The body has a groove formed therein and extends along the longitudinal axis thereof for advantageously receiving a male end portion of a wire when removed from an input jack. The body further has a visible front-end portion that has indicia thereon, corresponding to the rear end portion indicia of the male plug so that a user can conveniently identify a select input jack for receiving a corresponding wire. The front and rear end portion indicia preferably have identical numerals, and may conveniently have identical colors. Of course, various indicia may be employed by the present invention such as letter or symbols, for example, as well known to a person of ordinary skill in the art.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
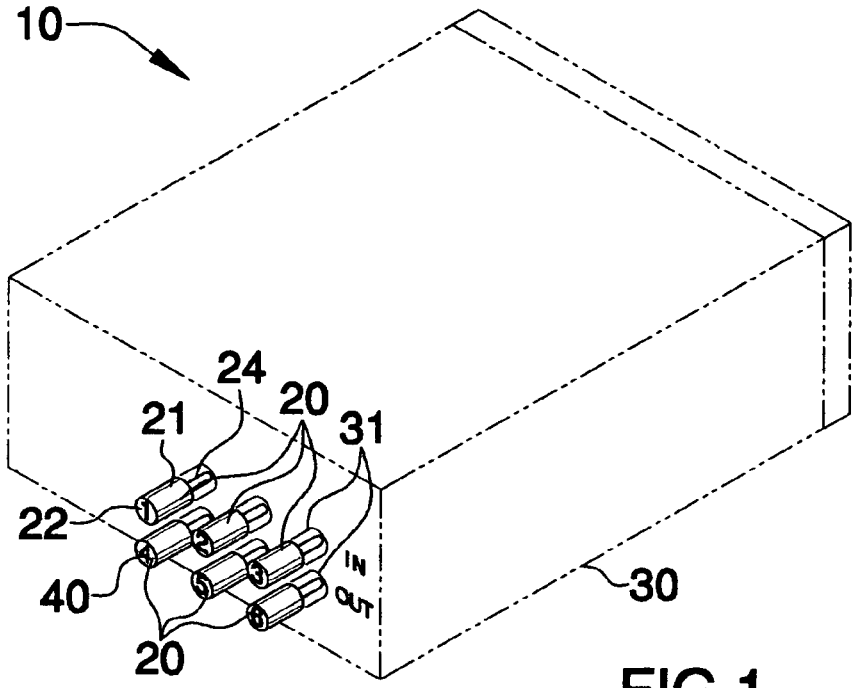
FIG. 1 is a perspective view showing a plurality of male wire-identification plugs attached to an electronic device, in accordance with the present invention.
Figure 2:
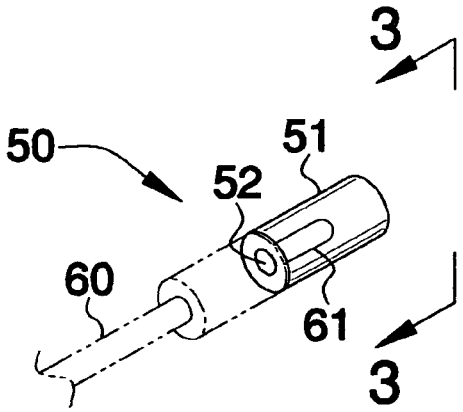
FIG. 2 is an enlarged perspective view of a female plug attached to a wire.
Figure 3:
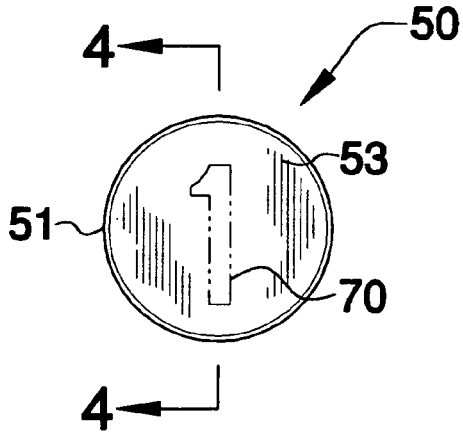
FIG. 3 is an enlarged front-elevational view of the female plug shown in FIG. 2.
Figure 4:
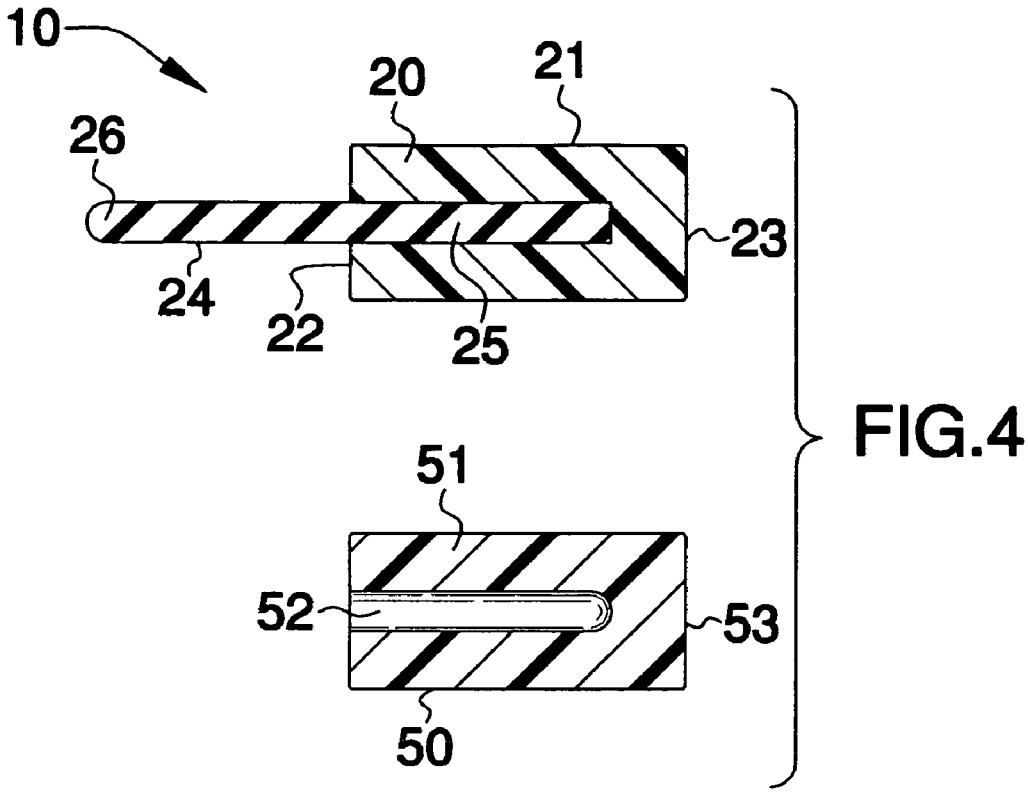
FIG. 4 is an enlarged cross-sectional view of the male and female plugs shown in FIG. 1 and FIG. 2.
Figure 5:
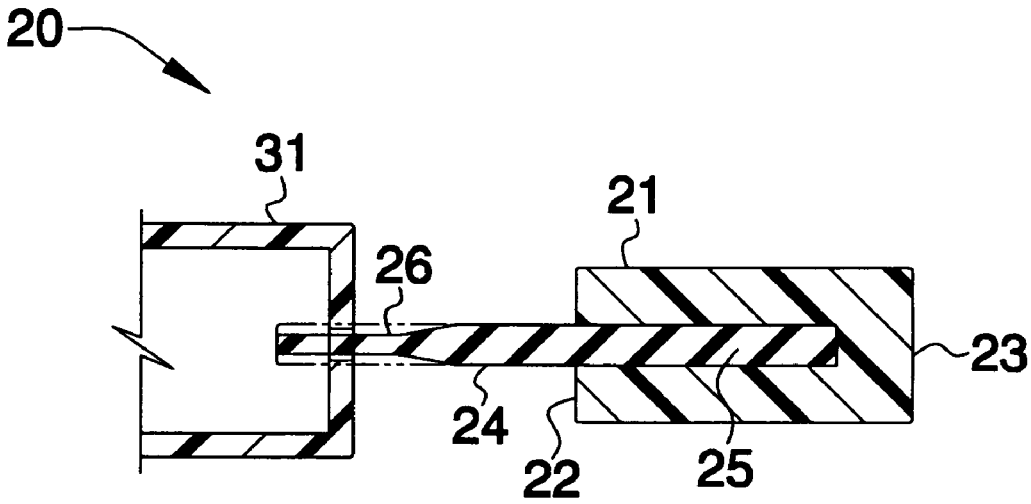
FIG. 5 is a cross-sectional view of the male plug shown in FIG. 1 wherein the prong section has been adapted to engage a corresponding electronic device.
Figure 6:
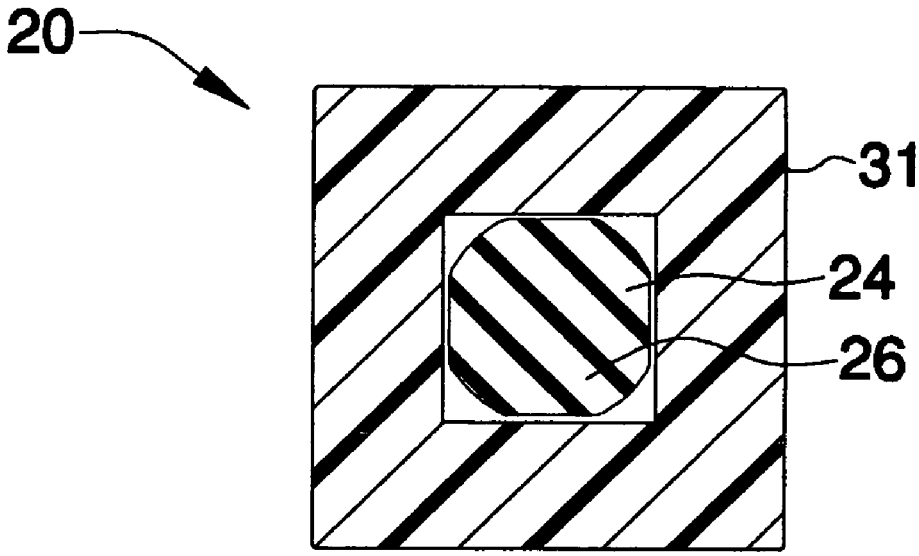
FIG. 6 is an enlarged cross-sectional view of the male plug shown in FIG. 1 wherein the prong section has been adapted to form an octagonal cross-section.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The kit of this invention is referred to generally in FIGS. 1–6 by the reference numeral 10 and is intended to provide a wire-identification plug kit for electronic devices. It should be understood that the kit 10 may be employed with various type of electronic devices and should not be limited to VCR's only.

Referring initially to FIG. 1, the kit 10 includes at least one male plug 20 that has a substantially cylindrical body 21 and front 22 and rear 23 end portions. The male plugs 20 are formed from non-conductive material and the body 21 has a centrally disposed longitudinal axis that includes an elongated prong section 24 extending therealong. The cylindrical non-conductive body 21 of the male plug 20 makes it safe and easy to grasp in order to remove or insert the plug 20 out of or into an input jack 31. The prong section 24 is integral with the body 21 and has a first end portion 25 disposed substantially medially of the front 22 and rear 23 end portions. The prong section 24 is formed from non-conductive material that is resilient so that the prong section 24 can be selectively adapted into a plurality of shapes as desired by a user. For example, the prong section 24 may be adapted to have an octagonal cross-section, in a preferred embodiment.

The prong section 24 further has a second end portion 26 spaced forwardly of the front-end 22 portion and is removably positionable into an input jack 31 of an electronic device 30. The rear end portion 23 of the body 21 advantageously has indicia 40 thereon, which is unique to the selected input jack 31.

The present invention further includes at least one female plug 50 that has a substantially cylindrical body 51 and a centrally disposed longitudinal axis. The female plugs 50 are formed from non-conductive material. The cylindrical non-conductive body 51 of the female plug 50 makes it safe and easy to grasp in order to attach or remove the plug 50 from a wire 60. The body 51 has a groove 52 formed therein and extends along the longitudinal axis thereof for advantageously receiving a male end portion 61 of a wire 60 when removed from an input jack 31. The groove 52 of the female plug 50 may also receive the prong section 26 of the male plug 20, allowing for easy storage of the kit 10 during non-operational periods.

The body 51 further has a visible front-end portion 53 that has indicia 70 thereon, corresponding to the rear end portion 23 indicia 40 of the male plug 20 so that a user can conveniently identify a selected input jack 31 for receiving a corresponding wire 60. The front 53 and rear end 23 portion indicia 70, 40 have identical numerals, and may conveniently have identical colors. Of course, various indicia 40, 70 may be employed by the present invention such as letter or symbols, for example, as well known to a person of ordinary skill in the art. The numbered indicia 40, 70 allow individuals that may suffer from colorblindness to easily install and reinstall their own electronic equipment, without having to pay someone for installation.

The appealing features of the kit 10 are its error prevention, ease of use, elimination of costly reinstallation fees, and convenience. The kit 10 makes the breakdown of any home entertainment equipment expedient and safe. Due to the numbering and coloring scheme of the kit 10 the component input jacks 31 and their corresponding wires 61 can easily be matched again upon reinstallation.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A kit for marking a predetermined position of at least one wire connected to an electronic device, said kit comprising:

at least one male plug having a substantially cylindrical body and front and rear end portions, said body having a centrally disposed longitudinal axis and including an elongated prong section extending therealong, said prong section being integral with said body and having a first end portion disposed substantially medially of said front and rear end portions and further having a second end portion spaced forwardly of said front end portion, said second end portion being removably positionable into an input jack of an electronic device, said male plug being spaced from the wire and prohibiting the wire from being inserted into the input jack when said male plug is positioned into the input jack, said prong section being formed from resilient material for being selectively adapted into a plurality of shapes as desired by a user, said rear end portion of said body having indicia thereon unique to a select input jack, said male plug having a longitudinal length shorter than a longitudinal length of the wire; and at least one female plug having a substantially cylindrical body and a centrally disposed longitudinal axis, said body having a groove formed therein and extending along the longitudinal axis thereof, the groove receiving a male end portion of a wire when the wire is removed from an input jack, said female plug prohibiting the wire from being positioned into the input jack when said female plug is attached to the wire, said body further having a visible front end portion having indicia thereon, said front end portion indicia corresponding to said rear end portion indicia so that a user can identify a select input jack for receiving a corresponding wire, said male plug having a longitudinal length shorter than a longitudinal length of the wire wherein said at least one male and female plugs are formed from non-conductive material respectively.

2. The kit of claim 1, wherein said front and rear end portion indicia have identical numerals.

3. The kit of claim 1, wherein said front and rear end portion indicia have identical colors.

4. The kit of claim 1, wherein said prong section is formed from non-conductive material.

5. The kit of claim 1, wherein said prong section has an octagonal cross-section.

6. A kit for marking a predetermined position of at least one wire connected to an electronic device, said kit comprising:

at least one male plug having a substantially cylindrical body and front and rear end portions, said body having a centrally disposed longitudinal axis and including an elongated prong section extending therealong, said prong section being integral with said body and having a first end portion disposed substantially medially of said front and rear end portions and further having a second end portion spaced forwardly of said front end portion for being removably positionable into an input jack of an electronic device, said prong section being formed from resilient material for being selectively adapted into a plurality of shapes as desired by a user, said rear end portion of said body having indicia thereon unique to a select input jack; and at least one female plug having a substantially cylindrical body and a centrally disposed longitudinal axis, said body having a groove formed therein and extending along the longitudinal axis thereof for receiving a male end portion of a wire when removed from an input jack, said body further having a visible front end portion having indicia thereon, said front end portion indicia corresponding to said rear end portion indicia so that a user can identify a select input jack for receiving a corresponding wire;

said at least one male and female plugs are formed from non-conductive material respectively;

wherein said prong section is formed from non-conductive material, said male and female plugs being coextensively shaped, said prong section having a tapered end portion for firmly fitting into the input jack, said male and female plugs being removably and directly engageable wherein said prong section is telescopically positional into the groove.

7. The kit of claim 6, wherein said front and rear end portion indicia have identical numerals.

8. The kit of claim 6, wherein said front and rear end portion indicia have identical colors.

9. The kit of claim 6, wherein said prong section has an octagonal cross-section.

* * * * *